United States Patent [19]

Chen

[11] Patent Number: 4,598,262

[45] Date of Patent: Jul. 1, 1986

[54] QUASI-OPTICAL WAVEGUIDE FILTER

[75] Inventor: Ming H. Chen, Ranco Palos Verdes, Calif.

[73] Assignee: TRW Inc., Redondo Beach, Calif.

[21] Appl. No.: 502,072

[22] Filed: Jun. 8, 1983

[51] Int. Cl.[4] ..... H01P 1/207

[52] U.S. Cl. ..... 333/208; 333/212; 333/21 A

[58] Field of Search ..... 333/208–212, 333/202, 239, 242, 248, 251, 254, 34, 21 A, 21 R

[56] References Cited

U.S. PATENT DOCUMENTS

| | | | |
|---|---|---|---|
| 2,476,034 | 7/1949 | Fox | 333/208 |
| 2,985,850 | 5/1961 | Crawford et al. | 333/21 R X |
| 3,146,414 | 8/1964 | Marcatili | 333/34 |

OTHER PUBLICATIONS

Saleh, Adel A. M., "An Adjustable Quasi-Optical Band Pass Filter: Parts 1 and 2" *IEEE Transactions on Microwave Theory & Techniques,* MTT22, #7, 7/1974, pp. 728–739.

*Primary Examiner*—Eugene R. LaRoche
*Assistant Examiner*—Benny Lee
*Attorney, Agent, or Firm*—Noel F. Heal; Robert M. Wallace

[57] ABSTRACT

A waveguide filter particularly well suited for use in the millimeter and submillimeter wavelength range of the spectrum. The filter includes a number of uniformly spaced gratings installed in a waveguide section and having grating strip patterns contoured to conform with a selected waveguide mode, such as the circular $TE_{11}$ mode. The gratings are angularly oriented in the manner of a free-space plane-wave quasi-optical filter and provide similar desired frequency characteristics, but without the disadvantages of large size and the need for planewave launchers.

11 Claims, 7 Drawing Figures

QUASI-OPTICAL WAVEGUIDE FILTER

BACKGROUND OF THE INVENTION

This invention relates generally to waveguide filtering devices, and more particularly, to filters for use with systems operating in the millimeter wavelength region of the electromagnetic spectrum. Waveguide filters, particularly bandpass filters, have a wide range of applications, for example in communication systems and radar systems. Conventional waveguide filters for these purposes are significantly limited by their small physical size, which increases the difficulty of manufacture, and relatively high losses. An alternative to the use of waveguide filters is a quasi-optical bandpass filter, apparently first proposed in 1974 by Adel Saleh, in a paper entitled "An Adjustable Quasi-Optical Bandpass Filter," published in IEEE Transactions on Microwave Theory and Techniques, Vol. MTT-22, No. 7, July 1974, pp. 728–39.

In this paper, the author pointed out that filtering operations at millimeter and submillimeter wavelengths, and in the far infrared region of the spectrum, could be performed at low loss and high power handling capability by employing a quasi-optical technique in free space rather than a conventional filter in a waveguide. The simplest and most common form of quasi-optical filter is a Fabry-Perot resonator employing two or more metallic grids for filtering. Such a filter has no provision for adjusting the bandwidth or shape of the frequency response. Accordingly, precise construction is required to provide the desired characteristics, and changes are difficult to effect.

Saleh proposed a plane-wave quasi-optical filter comprising three or more wire-grid polarizers whose planes are parallel and are spaced at intervals of typically a quarter wavelength. The bandwidth and shape of the frequency response of the filter can be adjusted by changing the relative angular orientations of the polarizers, without affecting the center frequency of the device. Saleh assumed in the first part of his paper that each wire-grid element was an ideal polarizer, i.e., an incident wave would be totally reflected if its electric field vector were parallel to the wires of the grid, and would be totally transmitted if the electric field vector were perpendicular to the wires of the grid. The mathematics of this type of filter are described in detail in the Saleh paper. Basically, the overall response characteristic of the device is developed by considering the operation each basic filter section, comprising two adjacent wire-grid polarizers. Each basic section has a reflection characteristic and a transmission characteristic. Although one such section cannot have one-hundred-percent transmission at any frequency, assuming the grids are oriented at different angles, a series of basic sections can provide for total transmission at certain frequencies, and total reflection at others, at least in theory.

The theory of the quasi-optical filter was further developed by the present inventor in two subsequent papers. In "The Network Representation and the Unloaded Q for a Quasi-Optical Bandpass Filter," IEEE Trans. Microwave Theory and Techniques, Vol. MTT-27, April 1979, pp. 355–60, the author presented a technique for computing the loss characteristic of quasi-optical filters. In "Design Formulas for a Quasi-Optical Diplexer or Multiplexer," IEEE Trans. Microwave Theory and Techniques, Vol. MTT-28, April 1980, pp. 363–68, formulas are developed for performing diplexing and multiplexing operations using quasi-optical filter devices.

Quasi-optical filters based on those first described by Saleh have a significant disadvantage when applied to systems operating in the millimeter wavelength range. The quasi-optical devices operate on the principle that the incident waves are plane waves travelling in free space. In typical applications, the incident waves will not be plane waves, and the aperture of each polarizer element may have to be as large as one hundred wavelengths across to simulate plane-wave operation. At millimeter wavelengths, this is a most inconvenient limitation. Another drawback to the use of quasi-optical filters is that plane-wave launching devices, such as parabolic reflectors, are required, one on each side of the filter device.

It will be appreciated from the foregoing that there is still a significant need for a filter device, particularly one that is operable in the millimeter wavelength range, providing the convenience of adjustability of the quasi-optical filter, but without the inherent disadvantages of that device. The present invention fulfills this need.

SUMMARY OF THE INVENTION

The present invention resides in a quasi-optical filter modified for operation in a conventional waveguide. The device of the invention employs two orthogonal waveguide modes instead of two orthogonal plane waves, thereby eliminating the need for a large aperture in the gratings of the device, and eliminating the need for plane-wave launchers.

Briefly, and in general terms, the invention comprises a waveguide and a plurality of screens or gratings (usually at least three) installed in the waveguide, each screen bearing the modal field pattern of a selected waveguide propagation mode, such as the $TE_{11}$ circular waveguide mode or $TE_{10}$ square waveguide mode. The screens are uniformly spaced at a distance equivalent to an odd number of quarter wavelengths, and are angularly oriented to provide a selected frequency characteristic.

In one preferred embodiment of the invention, the waveguide is circular in cross section and the screens are printed with the pattern of the $TE_{11}$ circular waveguide mode. Each of the screeens is formed in an aperture of a plate, such that when the plates are secured together they form a portion of the waveguide, with the screens disposed in it. Since each screen is contoured to conform with a selected mode, it presents an orthogonal screen to all other modes, and only the selected mode, in this case the $TE_{11}$ mode, will be excited. Consequently, the filter of the invention may be designated as a relatively large waveguide, to facilitate manufacture, and coupled to a smaller waveguide through appropriately tapered sections. Since the screens in the filter excite only the $TE_{11}$ mode, other modes of excitation in the larger waveguide will have no significant effect on the characteristics of the filter.

One preferred embodiment of the invention takes the form of a waveguide of circular cross section. Another embodiment employs a waveguide of square cross section. From a manufacturing standpoint, the square-cross-section device may be preferred over the one of circular cross section, since the contours of the grid pattern for the $TE_{10}$ mode in the square waveguide are parallel lines.

It will be appreciated from the foregoing that the present invention represents a significant advance in the field of waveguide filters. In particular, the filter of the invention has the advantages of low loss and ease of fabrication, usually associated with quasi-optical filters, but retains the important advantage of relative smallness of size, as in conventional waveguide filters. Other aspects and advantages of the invention will become apparent from the following more detailed description, taken in conjunction with the accompanying drawings.

DESCRIPTION OF THE PREFERRED EMBODIMENTS

Figures 1, 2, 5:
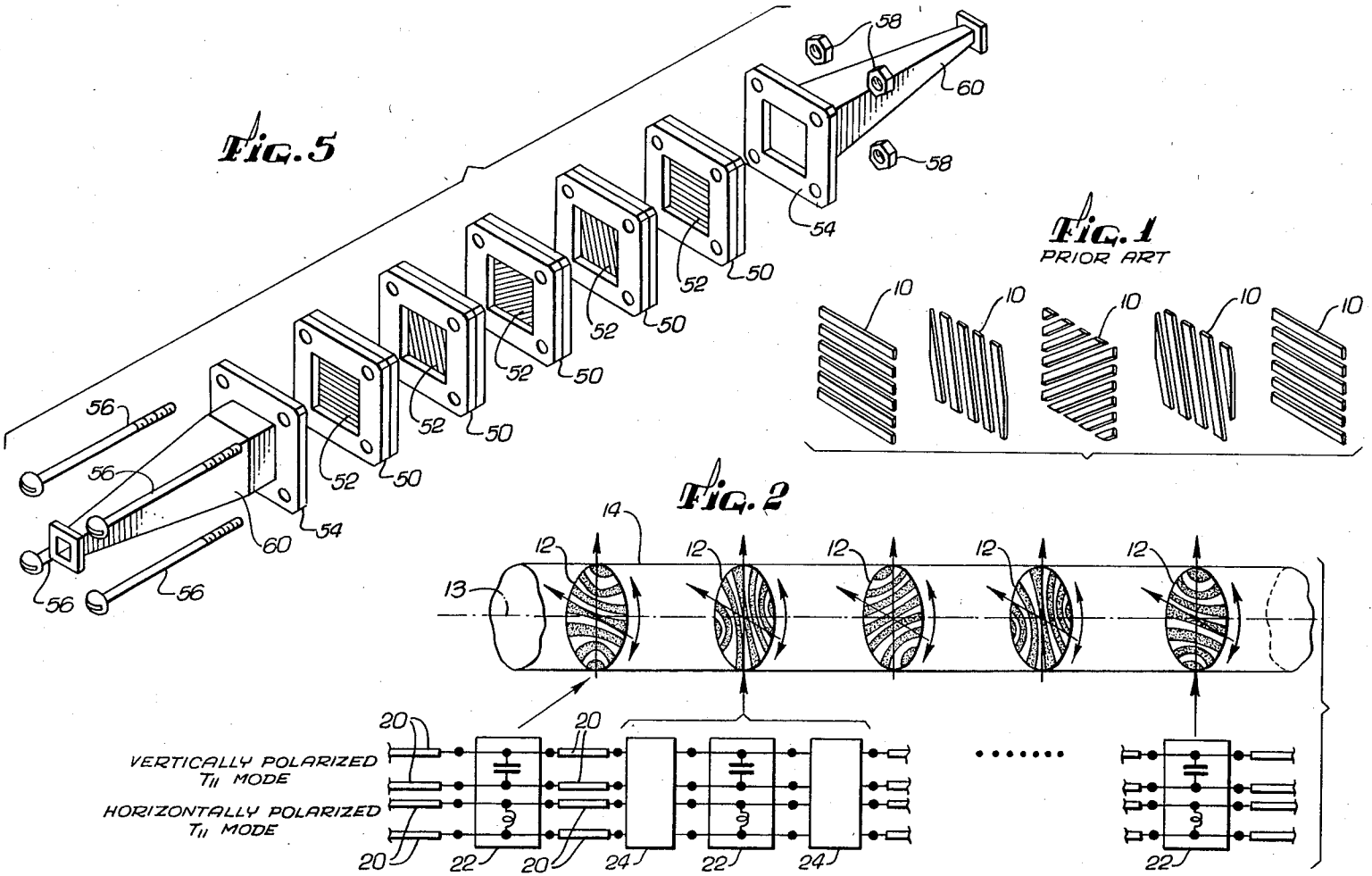
FIG. 1 PRIOR ART
FIG. 1 is a diagrammatical perspective view of a quasi-optical filter of the prior art.
FIG. 2 is a diagrammatical view of a quasi-optical waveguide filter in accordance with the invention, together with an equivalent circuit diagram of the filter.
FIG. 5 is an exploded perspective view of an alternate embodiment of the quasi-optical waveguide filter of the invention.

As shown in the drawings for purposes of illustration, the present invention is concerned with filters for use with electromagnetic waveguides. Although the principles of the invention are applicable to waveguides operating at any frequency, the invention may be used to best advantage in devices operating in the millimeter and submillimeter wavelength range.

FIG. 1 shows a quasi-optical filter of the prior art, for use on plane waves in free space. The filter includes an arrangement of five polarizing gratings, indicated by reference numeral 10, arranged in a parallel relationship and spaced uniformly apart by intervals of a quarter wavelength. Each grating consists of a series of parallel strips, and functions as a near-ideal polarizer on incident plane waves. An incident plane wave having an electric field vector perpendicular to the direction of the grid will be totally transmitted, and a wave having an electric field vector parallel to the direction of the grid will be totally reflected.

Each basic filter section, comprising any two adjacent ones of the gratings, operates on an incident wave and causes multiple reflections within the section. Relatively simple mathematical relationships permit the calculation of an overall transmission coefficient and an overall reflection coefficient for the basic filter section, as a function of the spacing and relative angular orientation of the two adjacent gratings. This analysis shows that a single basic section can function as a band-reject filter, but not as a bandpass filter. However, if two or more sections are cascaded in the same device, a bandpass filter characteristic can be obtained. These concepts and relationships were described in the paper by Saleh cited earlier in this specification, and are now well known in the field.

In accordance with the invention, the principles of the quasi-optical filter are applied in a waveguide filter, as shown in FIG. 2. A significant feature of the present invention is that the invention includes a plurality of gratings or screens 12 that are patterned with the modal field pattern of the $TE_{11}$ circular waveguide mode, and the screens are installed in a waveguide 14. Instead of being responsive to two orthogonal plane waves, the filter of the invention is responsive to two orthogonal waveguide modes, and the filtering takes place in a waveguide instead of in free space. Each of the circular gratings 12 may be individually rotated about the axis B. By selectively rotating each of the gratings 12, the bandpass characteristics (and specifically the band width) of the invention can be finely tuned, in accordance with the general principles described in the two above-referenced publications by the inventor.

The equivalent network of the filter is shown in the lower portion of FIG. 2 as including a cascading of transmission lines 20, capacitive and inductive loadings 22, and coupling transformers 24. The transmission lines 20 represent the two orthogonal waveguide modes. The capacitive and inductive loadings 22 represent the gratings that are perpendicular and parallel, respectively, to the electric field vector of the wave. The coupling transformers 24 indicate the coordinate rotation of the local waveguide modes. The equivalent network of the free-space, plane-wave filter of FIG. 1 is identical in appearance to that shown in FIG. 2, except that the transmission lines represent orthogonal plane waves in free space, instead of orthogonal waveguide modes, such as $TE_{11}$ modes.

Figures 3, 4:
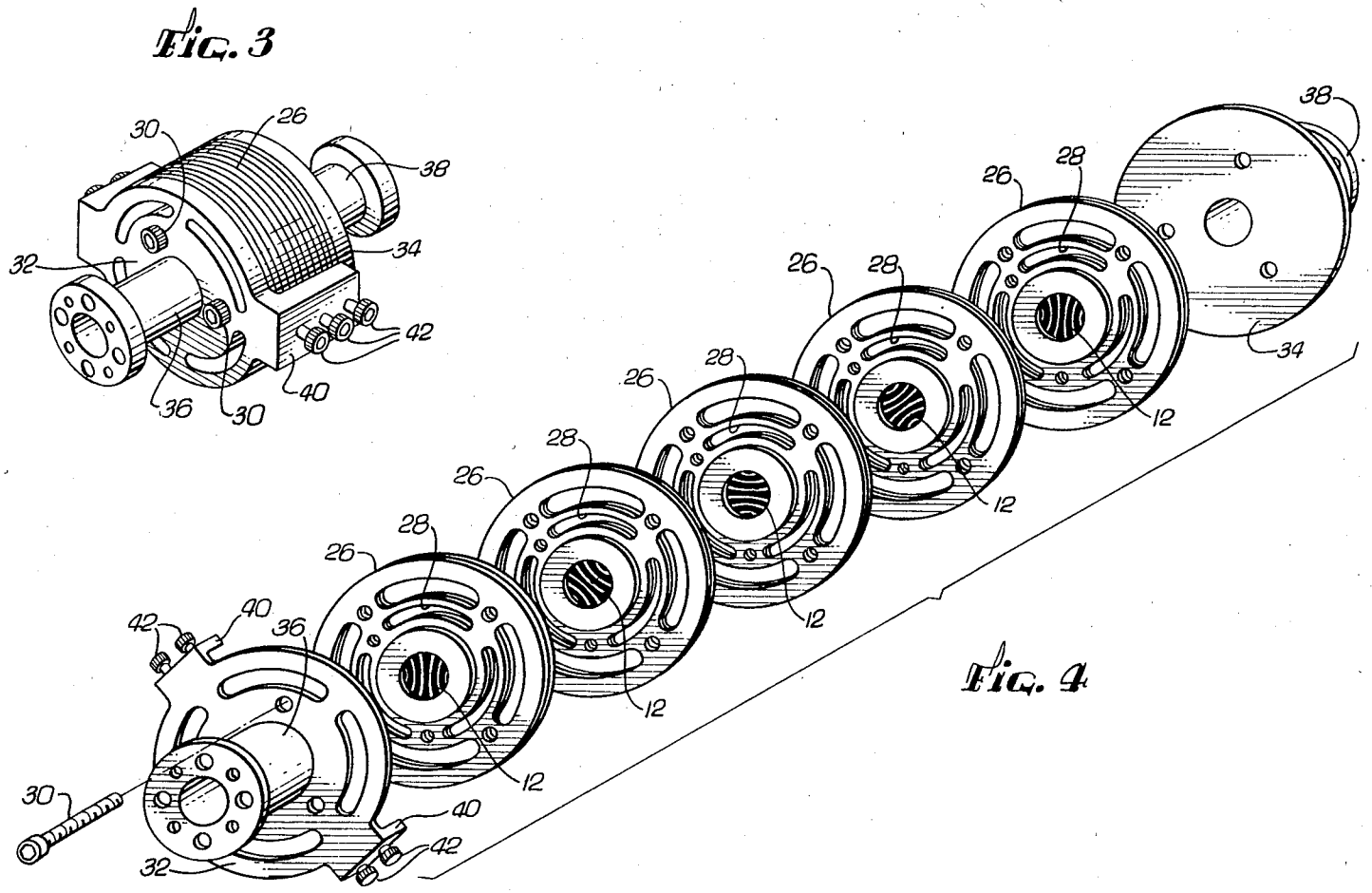
FIG. 3 is a perspective view of the filter of FIG. 2, shown in assembled form for coupling to a waveguide system.
FIG. 4 is an exploded perspective view of the filter shown in FIG. 3.

FIG. 3 shows the filter of the invention in assembled form, and FIG. 4 shows the same embodiment as an exploded view. Each of the gratings 12 is mounted in a central aperture of a circular metal disc 26 of substantial thickness. The grating patterns may be formed by any conventional technique. They may, for example, be made of copper deposited on Mylar and selectively etched away to form the required strips. Each of the discs 26 has a set of arcuate slots 28 through which bolts 30 extend to hold the discs in the assembled condition shown in FIG. 3. The arcuate slots permit the discs to be angularly displaced to obtain the desired frequency characteristics of the filter. Adjacent to the five discs 26 of the filter are two additional discs 32 and 34 which serve to hold the five discs in the assembled condition. The discs 32 and 34 have integral waveguide tube sections 36 and 38, respectively, the tube sections having flanged ends for coupling to other waveguide sections (not shown). The end disc 32 also has a pair of diametrically opposed integral bars 40 that extend along the peripheries of the discs 26. Screws 42 extend through the bars 40 and serve to further maintain the filter in its assembled condition.

Figure 6:
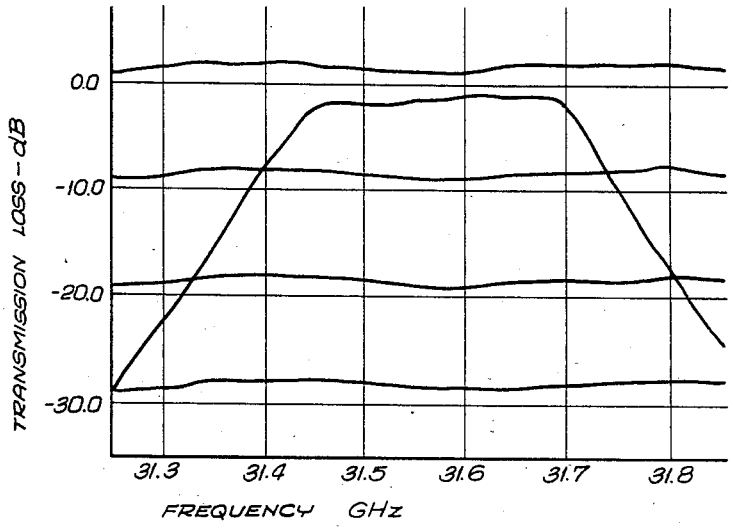
FIGS. 6 and 7 are graphs showing the frequency characteristics of an experimental filter constructed in accordance with the invention.
Figure 7:
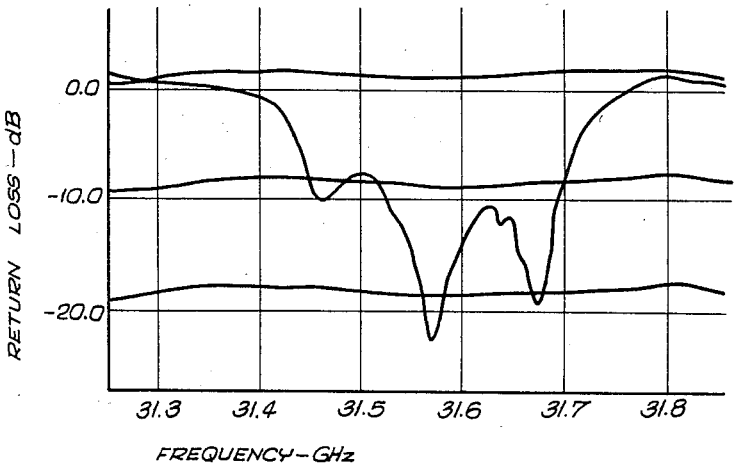

The experimental filter shown in FIGS. 3 and 4 was constructed as a three-pole Chebyshev filter with 0.01 dB ripple and one-percent fractional bandwidth. The filter's five gratings were oriented at angles of 0, 80.9, 169.7, 80.9, and 0 degrees, respectively. The spacing of the gratings was set at one quarter wavelength at the center frequency of the filter, and the circular waveguide had a diameter of 0.32 inch. The filter was tuned by adjusting the angular orientations of the grating elements, and the measured transmission and return losses are shown in FIGS. 6 and 7. It is expected that the insertion loss of the experimental filter may be improved by better mechanical design and compensation for mechanical tolerances to reduce leakage between cavities.

Another preferred form of the invention is shown in exploded form in FIG. 5. In this variation, the waveguide is of square cross section, and includes five square, frame-like elements 50, each having mounted in a square central aperture a grating 52 comprised of a set of parallel strips. Unlike the experimental version of FIGS. 2–4, this embodiment permits no angular adjustment of the gratings 52. The frame-like elements 50 are held together between two square end-plates 54 by four long bolts 56 and nuts 58. Each of the end plates also forms part of the waveguide, and is integrally formed with a tapered waveguide section 60 for coupling to other waveguide sections (not shown).

The waveguide of FIG. 5 is fabricated of oversized parts, for ease of manufacturing. Another advantage of the square-cross-section embodiment shown in FIG. 5 is that the gratings are more easily formed as parallel strips.

It will be appreciated from the foregoing that the present invention represents a significant improvement in the field of waveguide filters. The use of quasi-optical principles in a waveguide filter results in a combination that has the advantages of quasi-optical filters, specifically low loss and ease of fabrication, but without the disadvantage of relatively large size and the need for plane-wave launchers. It will also be appreciated that, although specific embodiments of the invention have been described in detail for purposes of illustration, various modifications may be made without departing from the spirit and scope of the invention. Accordingly, the invention is not to be limited except as by the appended claims.

I claim:

1. A quasi-optical waveguide filter, comprising:

a waveguide section, having an axis of energy propagation, and including means for coupling said section to other elements of a waveguide system;

a plurality of gratings installed in said waveguide section at uniform intervals along the axis of propagation and substantially perpendicular to it, each of said gratings having a pattern of conductive strips formed on an insulating layer, the pattern conforming to the contours of a selected waveguide mode, whereby each of said gratings is operative to selectively transmit a first wave in the selected waveguide mode, linearly polarized in a direction parallel with the strip pattern on a first one of said gratings, and a second wave in the selected waveguide mode, linearly polarized in a direction perpendicular to the first wave;

wherein the angular orientation of the first of said gratings is aligned with the direction of linear polarization with the first wave and the angular orientations of said gratings with respect to each other are selected to provide a selected frequency characteristic to said filter.

2. A quasi-optical waveguide filter as set forth in claim 1, wherein:

said waveguide section is formed in part as a plurality of frame elements, each having a central aperture, and means for fastening said frame elements together to form a tube;

said gratings are secured in said apertures of said frame elements; and said waveguide section further includes means for aligning and fastening said frame elements in said waveguide section.

3. A quasi-optical waveguide filter as set forth in claim 2, wherein:

said frame elements are circular in shape;

the selected waveguide mode is the $TE_{11}$ mode; and said filter includes means for adjusting the angular orientations of said gratings in said frame elements.

4. A quasi-optical waveguide filter as set forth in claim 2, wherein:

said frame elements are square in shape; and the selected waveguide mode is the $TE_{10}$ mode.

5. A quasi-optical waveguide filter as set forth in claim 2, wherein:

said means for coupling said waveguide section to other elements of a waveguide system include tapered waveguide means, whereby said waveguide section can be made of oversize parts for ease of manufacturing.

6. A quasi-optical waveguide filter as set forth in claim 4, wherein:

said means for coupling said waveguide section to other elements of a waveguide system include tapered waveguide means, whereby said waveguide section can be made of oversize parts for ease of manufacturing.

7. A quasi-optical waveguide filter as set forth in claim 3, wherein:

there are at least three of said gratings arrayed at quarter-wavelength intervals or odd multiples thereof; and said gratings are angularly oriented in such a manner as to provide a passband filter characteristic.

8. A quasi-optical waveguide filter as set forth in claim 4, wherein:

there are at least three of said gratings arrayed at quarter-wavelength intervals or odd multiples thereof; and said gratings are angularly oriented in such a manner as to provide a passband filter characteristic.

9. A quasi-optical waveguide filter, comprising:

a waveguide section having a longitudinal center axis extending therethrough; and a plurality of gratings installed in said waveguide section at uniform intervals along said longitudinal axis and extending transversely with respect to said longitudinal axis, each of said gratings having a conductive layer which is patterned in accordance with the contours of a selected waveguide mode, and each of said gratings is operative to selectively transmit a first wave in the selected waveguide mode, linearly polarized in a direction parallel with the strip pattern on a first one of said gratings, and a second wave in the selected waveguide mode, linearly polarized in a direction perpendicular to the first wave; and wherein the angular orientation of the conductive layer contours on each of said gratings about said longitudinal axis corresponds to a selected bandwidth of said filter, and said uniform intervals are directly proportional to the wavelength corresponding to a selected center frequency of the filter.

10. The quasi-optical waveguide filter of claim 9, wherein said uniform intervals correspond to a quarter wavelength at the center frequency or an odd multiple of a quarter wavelength.

11. The quasi-optical waveguide filter of claim 9 further comprising means for selectively rotating individual ones of said gratings about said longitudinal axis.

* * * * *